United States Patent [19]

Sloop

[11] Patent Number: 4,785,791

[45] Date of Patent: Nov. 22, 1988

[54] BOW SIGHT TRANSPORTATION COVER

[76] Inventor: John R. Sloop, 122 Pinetree Dr., Dothan, Ala. 36301

[21] Appl. No.: 154,803

[22] Filed: Feb. 11, 1988

Related U.S. Application Data

[63] Continuation of Ser. No. 793,236, Oct. 31, 1985, abandoned.

[51] Int. Cl.[4] ..... F41B 5/00; B65B 11/00; B65B 65/02

[52] U.S. Cl. ..... 124/88; 124/87; 124/24 A; 150/52 R; 33/265

[58] Field of Search ..... 124/88, 23 R, 24 A, 124/24 R, 23 A, 87; 150/52 G, 52 R; 33/265

[56] References Cited

U.S. PATENT DOCUMENTS

| | | | |
|---|---|---|---|
| 313,212 | 3/1885 | Kelfon | 33/244 |
| 3,840,944 | 10/1974 | Gresley | 124/23 A |
| 4,332,231 | 6/1982 | Napier et al. | 124/24 R |
| 4,363,312 | 12/1982 | Spitzke | 124/24 A |
| 4,394,797 | 7/1983 | Schuster | 33/244 |

FOREIGN PATENT DOCUMENTS

| | | | |
|---|---|---|---|
| 2843 | of 1885 | United Kingdom | 33/244 |

OTHER PUBLICATIONS

Archery article "The QD Hunting Quiver & Sight System", Jun. 1978, p. 5.

*Primary Examiner*—Richard C. Pinkham
*Assistant Examiner*—Gary Jackson
*Attorney, Agent, or Firm*—Hurt, Richardson, Garner Todd & Cadenhead

[57] ABSTRACT

A bow sight transportation cover having an essentially rectangular protective housing with one open side end into which the bow sight projects. The housing is secured to the central portion of the bow by slidably engaging a mounting bracket attached directly to the bow sight. The housing can be modified to slide either horizontally or vertically onto the mounting bracket. The bow sight cover can be constructed of transparent material and provided with a recess for the arrow to pass through. Alternatively, the vertical position of the housing can be adjusted by mounting the housing on an elongated bar which extends between the two end portions of the bow.

5 Claims, 3 Drawing Sheets

BOW SIGHT TRANSPORTATION COVER

This is a continuation of co-pending application Ser. No. 793,236 filed on Oct. 31, 1985, now abandoned.

FIELD OF INVENTION

The present invention relates to a bow sight cover and, more particularly, to a cover which attaches to the body of the bow to insure that the bow sight settings are not inadvertently altered when the bow is transported by the archer.

BACKGROUND OF THE INVENTION

Certain bow sight mechanisms consist of a group of adjustable pins set into a mounting bracket, which are set manually by the bow hunter to take into consideration such variables as arrow weight, yardage, and windage. The accurate setting of the sight pins is a time consuming and tedious process. Once the sight pins are adjusted for a particular set of variables, the bow hunter usually desires to maintain the pins in that position for as long as those variables remain constant. This is often difficult especially when the hunter is required to transport his bow over many miles of rough terrain in search of his prey. Sight pin guards have been devised for protecting the pin settings both in the field and while the bow is in storage.

Currently available sight pin guards consist of a narrow U-shaped bar that attaches to the bow sight and extends diagonally across the pins. Generally, the stalking of wild game involves maneuvering through dense brush in order to find a desirable location frequented by the particular game being hunted. Because the commercially available sight guards offer inadequate protection, the bow hunter is often required to reset the sight pins upon reaching his destination.

Accordingly, the principal objective of the present invention is to provide a new and improved bow sight cover which protects the setting of the sight pins during transportation and storage.

A further objective of the present invention is to provide a bow sight cover adapted to attach to the body of the bow via the bow sight attachment plate.

Another objective of the present invention is to provide a protective cover that does not require removal when shooting arrows.

And yet another objective of the present invention is to provide a protective cover that can be adjusted vertically to accommodate variously situated sight mechanisms.

SUMMARY OF THE INVENTION

The bow sight transportation cover of the present invention has been constructed to meet the above objectives. The cover comprises an essentially rectangular protective housing disposed forwardly of the bow sight having one open end into which the bow sight projects. The protective housing has a rearwardly extending member with horizontally situated upper and lower channels adapted to slidably engage a mounting bracket which is attached to the central portion of the bow via the bow sight. The mounting bracket comprises two rectangular plates joined together along their vertical axes, wherein the first rectangular plate extends rearwardly in parallel relationship to the bow and is attached to the bow by means of the bow sight attachment plate, and the second rectangular plate extends forwardly and is angled outwardly to be slidably engaged by the rearwardly extending member of the protective housing. The first rectangular plate of the mounting bracket and the rearwardly extending member of the housing have corresponding longitudinal slots through which a biasing mechanism extends for locking the housing to the mounting bracket when the housing is in its operative position.

Alternatively, the mounting bracket may have a vertically oriented groove and spring lock for receiving and securing the protective housing to the bow. When the housing slides vertically onto the mounting bracket, the housing is constructed having an open bottom end to permit the housing to slide downwardly over the sight mechanism.

The protective housing may also have a vertical groove and spring lock for receiving and securing an arrow quiver in a tongue and groove relationship.

The bow sight transportation cover may be constructed of transparent material having a horizontally extending recess adapted to permit an arrow to pass therethrough. This type of construction allows the bow hunter to shoot arrows without having to remove the protective cover. The transparent housing is secured to the bow in a manner similar to that described above.

Another alternate embodiment comprises an adjustable bow sight transportation cover wherein the protective housing is slidably mounted on an elongated bar which extends between the two end portions of the bow.

DETAILED DESCRIPTION OF THE INVENTION

Figure 1:
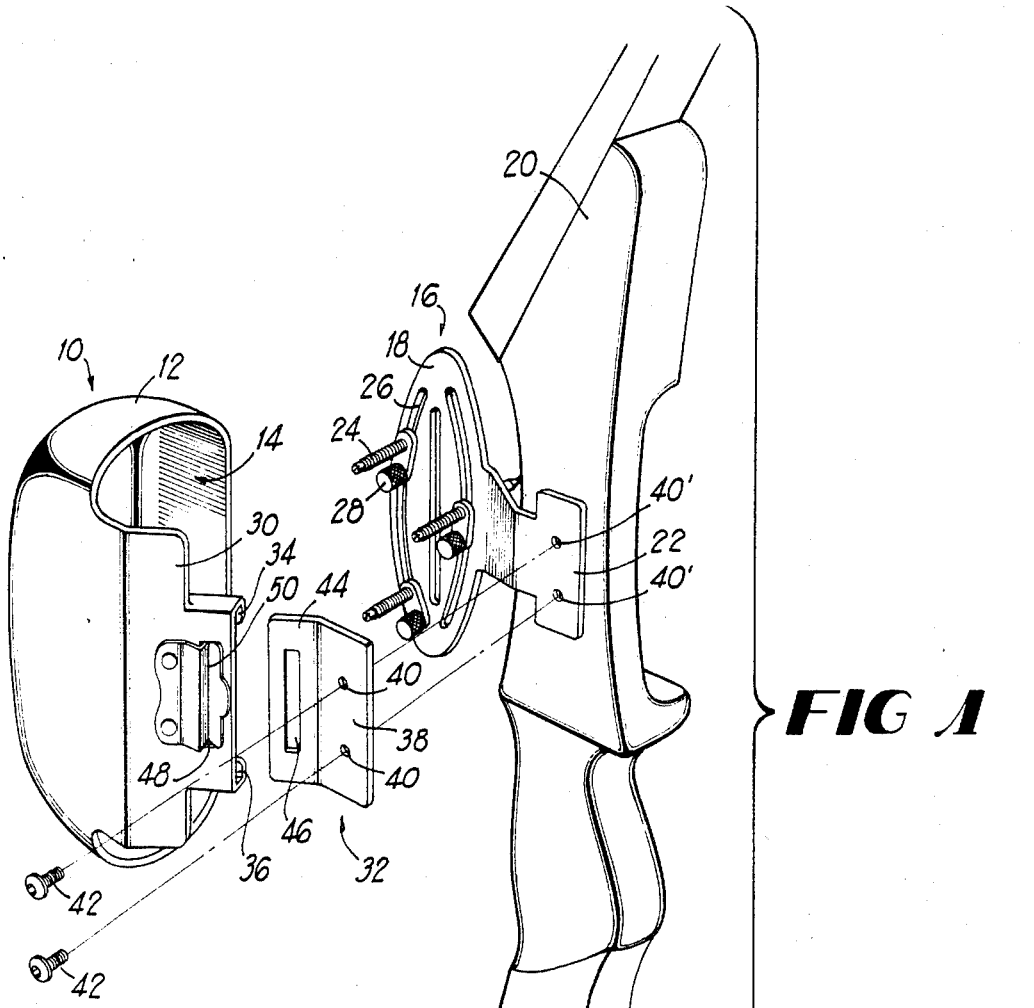
FIG. 1 is an exploded perspective view of one embodiment of a bow sight transportation cover.
Figure 2:
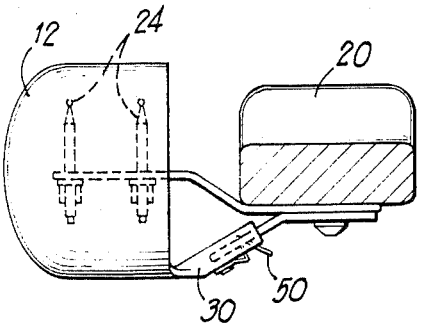
FIG. 2 is a plan view of the bow sight transportation cover attached to the bow shown in cross section.

In reference to the drawings, bow sight transportation cover 10 is illustrated in FIG. 1 and includes protective housing 12 having a generally rectangular shape with one open side end 14 into which bow sight 16 projects. Bow sight 16 is illustrated having an elliptical plate 18 which is secured to the approximate center portion of bow 20 by bow sight attachment plate 22. It will be understood, however, that hunting sights are available in an assortment of geometric configurations, the elliptical configuration of FIG. 2 being for illustrative purposes only. Bow sight pins 24 sit into pin slots 26 and are readily adjusted by loosening shank heads 28 and repositioning sight pins 24 within pin slots 26.

Figure 3:
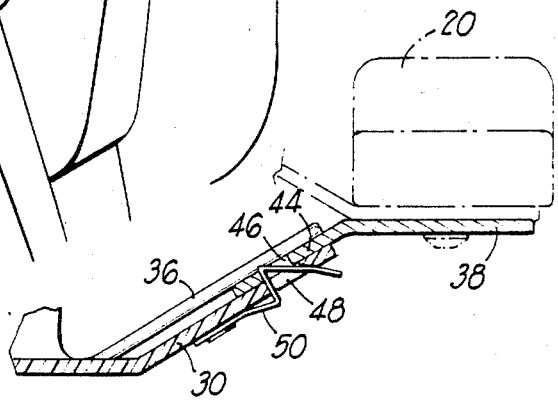
FIG. 3 is an enlarged plan section view of the bow sight cover.
Figure 6:
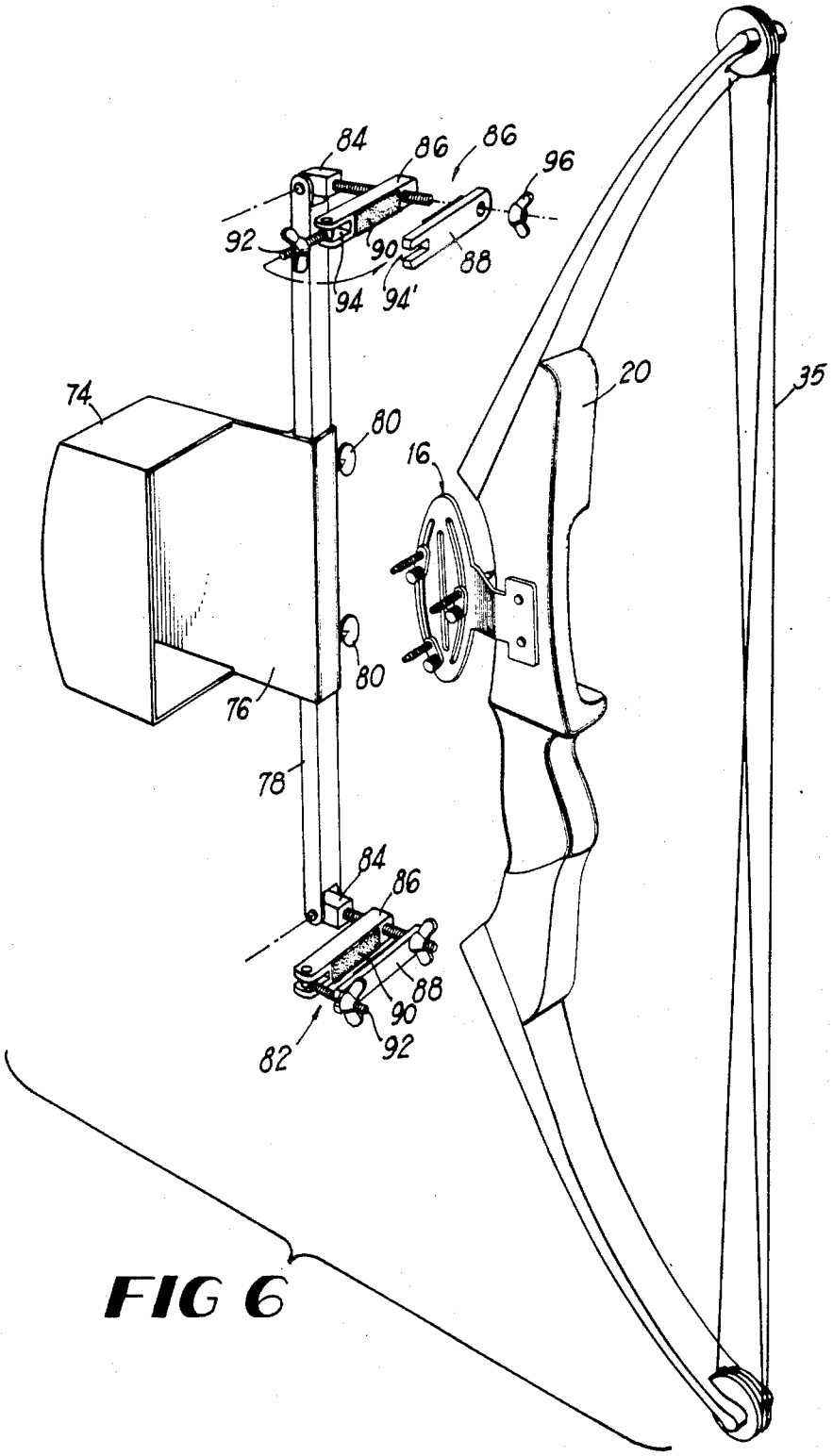
FIG. 6 is a final alternate embodiment showing a perspective view of the bow sight transportation cover, exploded away from the bow and sight mechanism.

Protective housing 12 has a rearwardly projecting member 30 which is adapted to slidably engage mounting bracket 32 via horizontal upper channel 34 and horizontal lower channel 36. Rearwardly, for this invention, is defined as that direction toward bow string 35 (FIG. 6). Mounting bracket 32 comprises two rectangular plates, a first rectangular plate 38 extends rearwardly and mounts directly onto bow sight attachment plate 22. As illustrated in FIG. 1, bow sight attachment plate 22 and first rectangular plate 38 have correspondingly aligned apertures 40 and 40' for receiving screws 42. A second rectangular plate 44 extends forwardly and outwardly so that when housing 12 is slidably engaged thereon, it does not disturb bow sight pins 24. Second rectangular plate 44 has a first longitudinal slot 46 which corresponds to a second longitudinal slot 48 in housing member 30 through which biasing mechanism 50 extends for locking housing 12 to bracket 32 when housing 12 is in its operative position. Biasing mechanism 50 and corresponding slots 46 and 48 are illustrated in more detail in FIG. 3.

Figure 4:
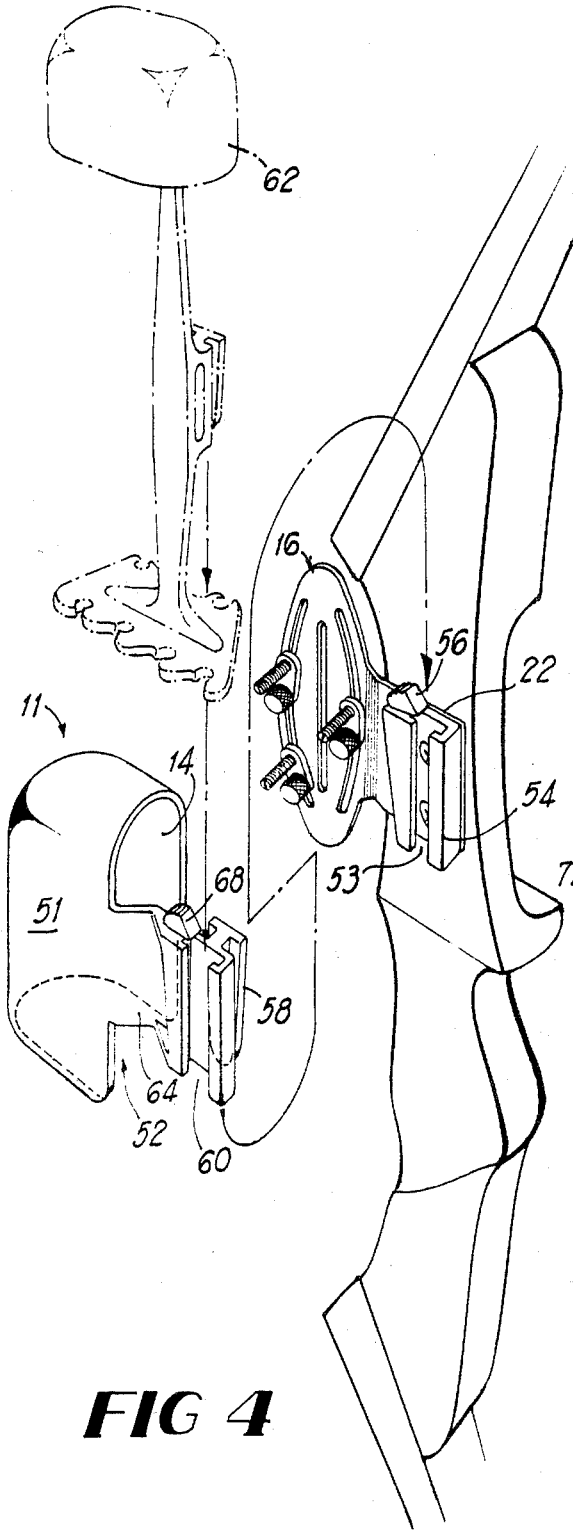
FIG. 4 is an exploded perspective view of an alternate embodiment of the bow sight cover.

An alternate embodiment is illustrated in FIG. 4 wherein bow sight transportation cover 11 comprises protective housing 51 having, in addition to open side end 14, open bottom end 52. Bow sight attachment plate 22 is fitted with a first vertical groove 53, frame 54 and a first spring lock 56 for receiving clamp 58 which has a second vertical groove 60 for receiving quiver 62. Protective housing 51 has a rearwardly projecting member 64 which is similar to the rearwardly projecting member 30 of FIG. 1, except that member 64 is provided with the second vertical groove 60 and second spring lock 68 for sliding on to and securing housing 51 to clamp 58.

Bow sight transportation covers 10 and 11 are constructed of sturdy, but preferably light weight materials such as plastic, aluminum or light weight steel.

Figure 5:
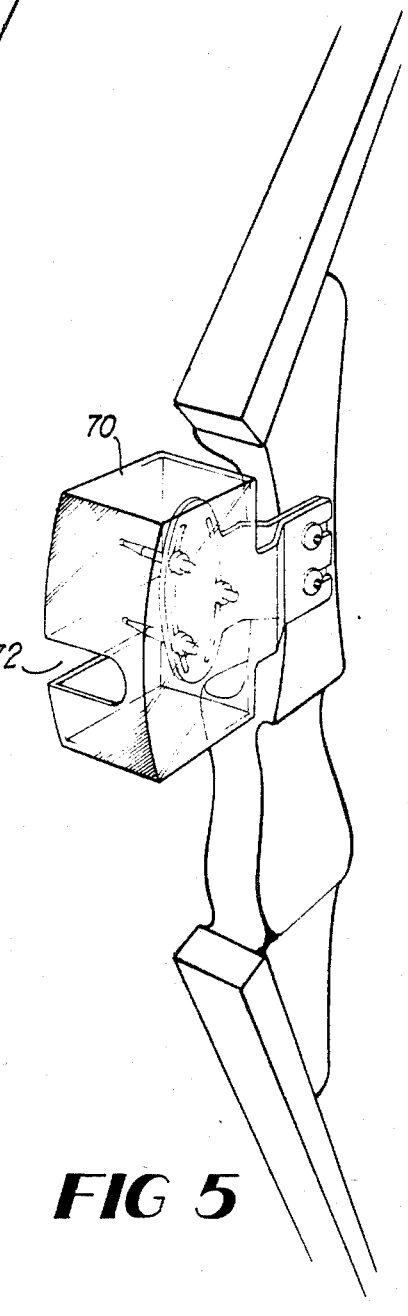
FIG. 5 is a perspective view of an additional alternate embodiment of the bow sight cover.

By constructing a bow sight transportation cover 70, as illustrated in FIG. 5, out of a transparent material such as lucite, it is unnecessary to remove the cover even when shooting arrows. Horizontally extending recess 72 is provided to enable arrows to pass through protective cover 70.

In some instances, it may be desirable to adjust bow sight transportation cover vertically. Cover 74, illustrated in FIG. 6, has been designed for this type of adjustment by providing rearwardly projecting member 76 with a vertical opening for slidably engaging elongated bar 78. Set screws 80 can be tightened, once cover 74 is in its correct position. The ends of elongated bar 78 are provided with end clamps 82 for securing protective cover 74 to the end portions of bow 20. Clamps 82 have the capability of fitting variously angled bow end portions by adjusting pivotal joints 84. Forward bars 86 and rearward bars 88 have rubber pads 90 attached to the inner surfaces which come in contact with the bow to prevent scratching or marring of the bow finish. Quick release of clamps 82 is provided by pivotally mounting bolt 92 in slots 94 and 94'. Butterfly nut 96 allows one to release clamps 82 by hand.

Whereas the present invention has been described in particular relation to the drawings attached hereto, it should be understood that other and further modifications, apart from those shown or suggested herein may be made within the spirit and the scope of this invention.

What is claimed is:

1. A bow sight transportation cover for covering and protecting a protruding portion of a bow sight which is mounted by its other portion to a bow, said bow sight being of a type in which said protruding portion of said bow sight extends outwardly beyond said bow, said bow sight cover comprising:

(a) a cup shaped protective housing having a side portion and a top closing one end of said side portion, said side portion and said top defining a hollow interior with an open end, so that when said housing is installed in its protective position over said protruding portion of said bow sight, said housing will encompass a portion of the protruding portion of said bow sight, said housing having an interior depth from said open end to said top sufficient for a portion of said bow sight to be received within the interior of said housing when said housing is in said protective position;

(b) a mounting bracket connected to said housing and for mounting on said bow, said mounting bracket when mounted on said bow having a first portion thereof on said bow and a second portion thereof secured to said housing, for supporting said housing in a spaced relationship to said bow;

(c) securing means connected to said first portion of said mounting bracket for holding said first portion of said mounting bracket in a prescribed position with respect to said bow sight; and (d) detent means connected to said securing means for releasably securing said securing means in said prescribed position on said bow, whereby said mounting bracket supports said housing in its protective position in which said housing is in a stationary position with respect to said bow and encompasses a portion of said bow sight with the interior of said housing being spaced from said portion of said bow sight and said securing means being releasable by said detent means to permit said mounting bracket to be released from said bow so that said housing and said mounting bracket can be removed from said bow and from the protective position of said housing with respect to said portion of said bow sight.

2. The bow sight transportation cover defined in claim 1 wherein said mounting bracket comprises two rectangular plates overlapping each other, one of said rectangular plates angling outwardly from said bow and the other of said rectangular plates being secured to said housing.

3. The bow sight transportation cover defined in claim 1 wherein said securing means includes screws received through said first portion and said detent means includes means on the central portion of said bow for receiving said screws, said screws passing through said first portion of said mounting bracket.

4. The bow sight transportation cover defined in claim 1 wherein said first portion of said bracket and said second portion of said bracket are a pair of separate elements, and including latch means for removably latching two elements together.

5. A bow sight transportation cover for covering and protecting a protruding portion of a bow sight which is mounted by its other portion to the central portion of a bow, said bow sight being of a type in which said protruding portion of said bow sight extends beyond said central portion of said bow and includes a plate and spaced pins extending from said plate, said bow sight cover comprising:

(a) a cup-shaped protective housing having a side portion and a top closing one end of said side portion, said side portion and said top defining a hollow interior with an open end, so that when said housing is installed in its protective position over said protruding portion of said bow sight, said housing will encompass all of said pins, said housing having an interior depth from said open end to said top sufficient for all of said pins and at least a portion of said plate to be received within the interior of said housing when said housing is in said protective position;

(b) a pair of mounting members respectively secured to said housing and securable to said bow, one of said mounting members when mounted on said bow having a portion thereof protruding toward said housing, the other one of said mounting members adapted to be mounted on said bow and protruding therefrom toward the mounting member secured to said housing, when said housing is in its protective position, whereby portions of said mounting members overlap;

(c) guide means on one of said mounting members for holding said portion of one of said mounting members in a prescribed position with respect to said portion of the other of said mounting members; and (d) latch means on said portion of one of said mounting members and engageable with said portion of the other of said mounting members for releasably securing said mounting members in said prescribed position with respect to each other, whereby when said mounting members are in their prescribed positions said mounting members support said housing in its protective position in which said housing is in a stationary position with respect to said bow and encompasses a portion of said plate and said pins, the interior of said housing being spaced from said portion of said plate and said pins, and said latch means being releasable to permit said portion of one of said members to be released from the other member so that said housing can be removed from its protective position.

* * * * *